US006330406B1

(12) United States Patent
Yamaguchi

(10) Patent No.: US 6,330,406 B1
(45) Date of Patent: Dec. 11, 2001

(54) TONER CONCENTRATION DETECTING APPARATUS INCLUDING POWER SUPPLY FOR APPLYING REVERSIBLE VOLTAGE TO THE TONER

(75) Inventor: Chiseki Yamaguchi, Niigata (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/369,369

(22) Filed: Aug. 6, 1999

(30) Foreign Application Priority Data

Aug. 7, 1998 (JP) ..... 10-224737

(51) Int. Cl.[7] ..... G03G 15/10
(52) U.S. Cl. ..... 399/58; 399/62
(58) Field of Search ..... 399/58, 57, 59, 399/61, 62; 73/61.41, 61.71, 61.72; 324/444, 693, 694, 713, 717, 722; 204/193

(56) References Cited

U.S. PATENT DOCUMENTS

| | | | | |
|---|---|---|---|---|
| 3,659,193 | * | 4/1972 | Pitsch et al. | 324/444 |
| 4,257,347 | * | 3/1981 | Stahl | 399/57 X |
| 5,724,629 | * | 3/1998 | Iino et al. | 399/57 |
| 5,942,388 | * | 8/1999 | Willner et al. | 204/193 X |

FOREIGN PATENT DOCUMENTS

| | | | |
|---|---|---|---|
| 50-145146 | | 11/1975 | (JP) . |
| 5559475 | | 5/1980 | (JP) . |
| 611469 | | 1/1994 | (JP) . |
| 6-11469 | * | 1/1994 | (JP) . |
| 6-222680 | * | 8/1994 | (JP) . |
| 6222680 | | 12/1994 | (JP) . |
| 915982 | | 1/1997 | (JP) . |
| 11-52737 | | 2/1999 | (JP) . |
| 11-65297 | * | 3/1999 | (JP) . |

* cited by examiner

*Primary Examiner*—Quana M. Grainger
(74) *Attorney, Agent, or Firm*—Ostrolenk, Faber, Gerb & Soffen, LLP

(57) ABSTRACT

A toner concentration detecting apparatus, which can accurately detect a toner concentration of a developer without being influenced by ions, is provided. A first electrode and a second electrode are disposed face to face with a developer between the electrodes. First, a voltage of a first power supply is applied to the electrodes. After a designated time, by switching means, a voltage of a second power supply, whose polarity is different from the first power supply, is applied to the electrodes. By using a changing of current flowing between the electrodes caused by the difference between the transferring speed of toner particles and that of ions after switching the polarity of the power supply, a toner concentration calculating means calculates the toner concentration of the developer by using a table showing the relation between a peak value by the toner particles and the toner concentration. With this, the toner concentration can be calculated accurately.

14 Claims, 5 Drawing Sheets

BEFORE ELECTRIC FIELD IS REVERSED

AFTER ELECTRIC FIELD IS REVERSED 1
(RIGHT AFTER REVERSED)

AFTER ELECTRIC FIELD IS REVERSED 2
(IONS REACH TO ELECTRODES BEFORE TONER PARTICLES)

AFTER ELECTRIC FIELD IS REVERSED 3
(TONER PARTICLES REACH TO ELECTRODE AFTER IONS)

TONER CONCENTRATION DETECTING APPARATUS INCLUDING POWER SUPPLY FOR APPLYING REVERSIBLE VOLTAGE TO THE TONER

BACKGROUND OF THE INVENTION

The present invention relates to a toner concentration detecting apparatus and a program storage medium for this apparatus, which is utilized for an image forming apparatus such as an electrophotographic printing apparatus used a liquid developing system.

Description of the Related Art

In a conventional image forming process using a developer that contains charged toner particles in a carrier liquid, the image quality is influenced by the concentration of toner particles and the electric charge of toner particles in the developer. Consequently, it is necessary that the concentration of toner particles in the developer is kept stable. Therefore, for example, Japanese Patent Application Laid-Open No. HEI 11-52737 discloses a technology that controls the toner concentration by detecting the electric conductivity of the developer, by using orthogonal electric fields. In another technology, a light transparency factor is used to control the toner concentration.

However, in the method detecting the light transparency factor, there are problems that dust on an optical window has to be cleaned and a method for a color image has to be established. And in the method detecting the electric conductivity, there exists the influence of ions (counter ions and excess ions) besides the toner particles. Therefore, there is a problem to be solved how to detect the electric conductivity by only the toner particles, by eliminating or decreasing the influence of the counter ions and excess ions.

Japanese Patent Application Laid-Open No. SHO 50-145146 discloses a toner concentration controlling method and an apparatus thereof, which disposes a pair of electrodes and applies an alternating pulse to the electrodes and detects a toner concentration by measuring the electric conductivity between the electrodes. However, in this method, the influence of ions contained in the developer is not considered, therefore there is a problem that the toner concentration can not be detected accurately.

SUMMARY OF THE INVENTION

It is therefore an object of the present invention to provide a toner concentration detecting apparatus and a program storage medium for this apparatus and a data storage medium for this apparatus, which can eliminate the influence of ions and can accurately measure a toner concentration in a developer that contains charged toner particles in the carrier liquid, by eliminating the influence of ions by switching the direction of electric field generated by electrodes disposed facing each other with the developer between the electrodes.

According to the present invention, for achieving the objects mentioned above, there is provided a toner concentration detecting apparatus, including a first electrode and a second electrode which are disposed face to face with a developer between said electrodes, two power supplies having opposite polarities, each of which is connectable for applying a voltage to said first electrode and said second electrode at the same time, a switching means which switches the polarity of said first and second electrodes by switching from one power supply to the other power supply, after one power supply has applied a voltage to said first electrode and said second electrode for a designated time, a detecting means which detects current flowing between said first electrode and said second electrode, at the time after applying voltage to said first electrode and said second electrode and after the polarity of said electrodes has been switched, and a calculating means which calculates a toner concentration of said developer, based on detected current values.

According to the present invention, in a toner concentration detecting apparatus, there is provided a program storage medium, in which the following steps are included: applying voltage to a first electrode and a second electrode which are disposed face to face with a developer between said electrodes from one of a plurality of power supplies for a designated time, switching polarity of said power supplies by switching from one of the power supplies to the other of the power supplies, after said voltage is applied to said electrodes from one of the power supplies, detecting current flowing between said first electrode and said second electrode, at the time after applying voltage to said first electrode and said second electrode and after switching the polarity of said power supplies, and calculating a toner concentration of said developer, based on detected current values.

According to the present invention, in a toner concentration detecting apparatus and a program storage medium for this toner concentration detecting apparatus, said toner concentration may be calculated by using a table which shows the relation between the toner concentration and the current values which change under the influence of the concentration of toner particles. Or said toner concentration may be calculated by using a peak value of a detected current due to the concentration of toner particles in a range in which said detected current values change. Or said toner concentration may be calculated according to a slope in a graph of detected current from the time when said electric field is reversed to the time when said detected current values reach a peak value due to concentration of toner particles in a range where a change in said detected current values occurs. Or said toner concentration may be calculated according to a time from the time when said polarity of said power supplies is switched to the time when said detected current values reach a peak value due to toner particles at a certain range where said detected current values change. Or said toner concentration may be calculated by the relation between a current value due to ions and a current value due to toner particles at a certain range where said detected current values change.

According to the present invention, said first electrode and said second electrode may be rotating cylindrical electrodes, and additionally cleaners, which clean surfaces of said rotating cylindrical electrodes, can be provided.

According to the present invention, in a toner concentration detecting apparatus, a data storage medium is provided, which stores data constituting a table, which shows the relation between the toner concentration and the current values due to toner particles flowing between a first electrode and a second electrode disposed face to face with a developer between the electrodes.

BRIEF DESCRIPTION OF THE DRAWINGS

The objects and features of the present invention will become more apparent from the consideration of the following detailed description taken in conjunction with the accompanying drawings in which.

DESCRIPTION OF THE PREFERRED EMBODIMENTS

Figure 1:
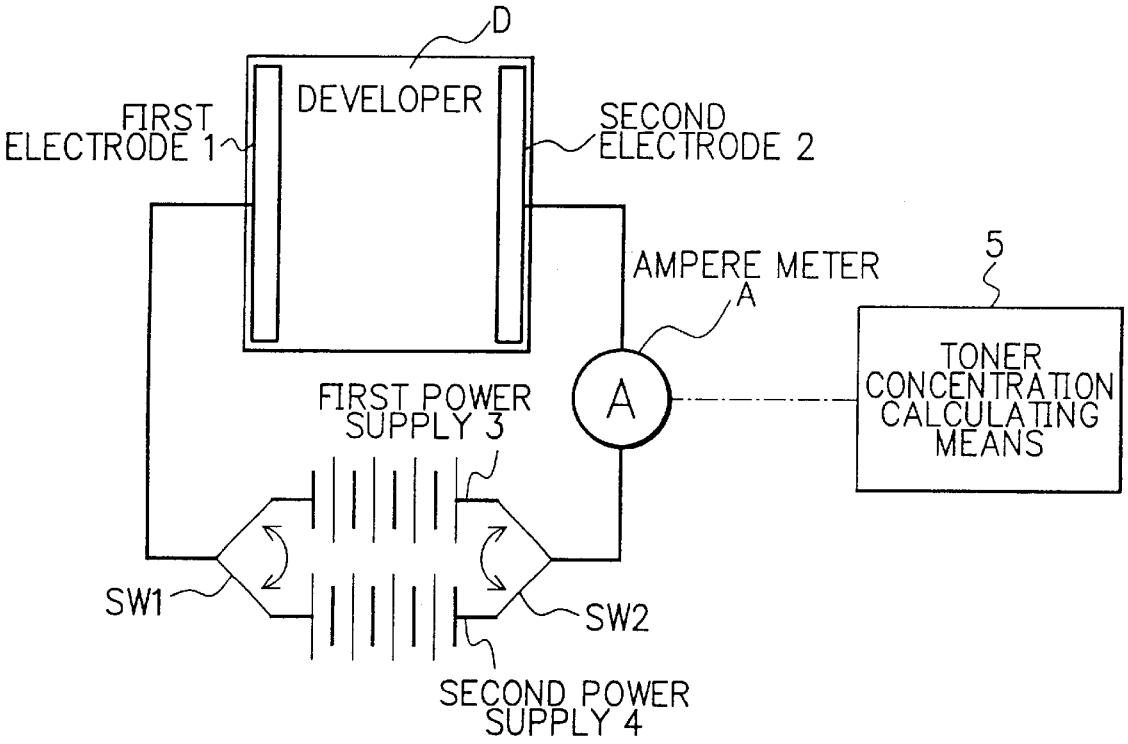
FIG. 1 is a diagram showing the structure of a first embodiment of a toner concentration detecting apparatus of the present invention.

Referring now to the drawings, embodiments of the present invention are explained in detail. FIG. 1 is a diagram showing the structure of a first embodiment of a toner concentration detecting apparatus of the present invention. In FIG. 1, the toner concentration detecting apparatus provides a first electrode 1 and a second electrode 2 that are disposed facing each other with a developer D between the electrodes. The apparatus further provides a first power supply 3 and a second power supply 4, whose polarities are different from each other, connect to the first electrode 1 and the second electrode 2 via switches and which generate an electric field in the developer D. And the apparatus additionally provides switches SW1 and SW2 that switch the first power supply 3 and the second power supply 4, an ampere meter A for detecting a current flowing into the second electrode 2, and a toner concentration calculating means 5 which calculates a toner concentration in the developer D based on the values measured by the ampere meter A.

Next the operation of the toner concentration detecting apparatus of the present invention is explained. In the developer which contains charged toner particles in the carrier liquid, in addition to the toner particles, charged, counter ions and excess ions generated mainly by a charge control agent (CCA) within the developer exist. The counter ions have a polarity opposite to the polarity of the toner particles, and the excess ions have the same polarity as the charged polarity of the toner particles. In this a case, of the developer D, it will be assumed that the particles are positively charged.

Figure 2A:
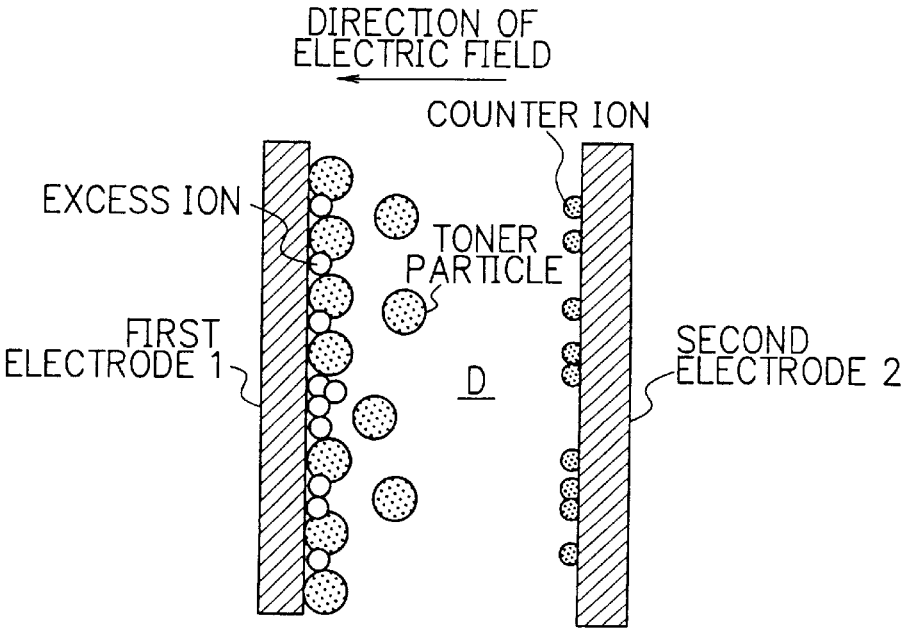
FIG. 2A is a diagram showing a state of toner particles and ions at a time before the electric field is reversed.

First, the first electrode 1 and the second electrode 2 are connected to the first power supply 3 via switches SW1 and SW2 and a voltage is applied to these electrodes. With this, an electric field is generated at the direction from the second electrode 2 to the first electrode 1. As a result, the positive toner particles and the excess ions are transferred to the direction of the first electrode 1 and the counter ions are transferred to the direction of the second electrode 2. FIG. 2A is a diagram showing a state of toner particles and ions at the time before the electric field is reversed.

Figure 2B:
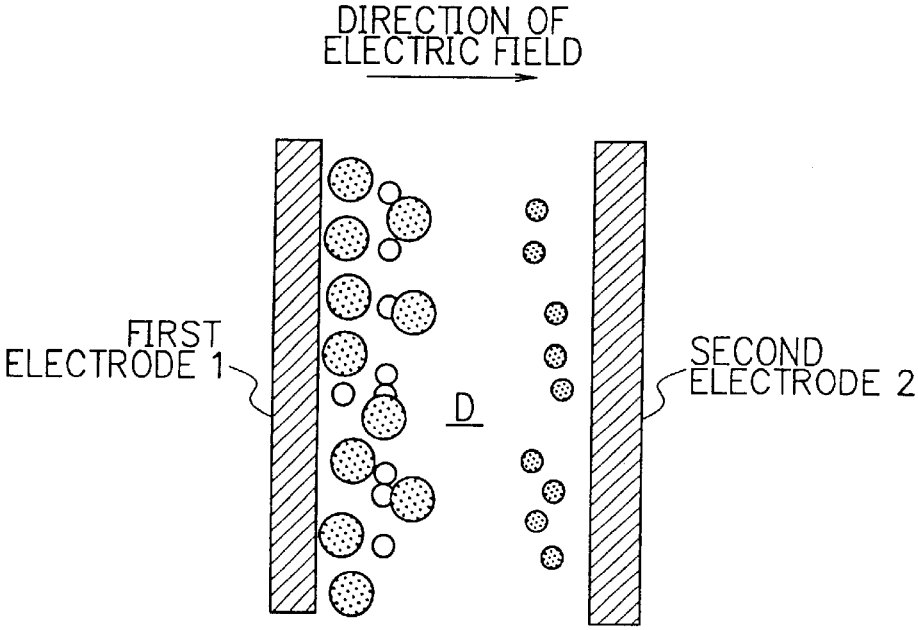
FIG. 2B is a diagram showing toner particles and ions being transferred by the direction of electric field at a time right after the electric field is reversed.

Next, after a designated time, by switching the switches SW1 and SW2 at the same time, the first electrode 1 and the second electrode 2 are connected to the second power supply 4 and this voltage is applied to these electrodes. With this, the direction of the electric field generated between the first electrode 1 and the second electrode 2 is reversed. As a result, the positive toner particles and the excess ions that were at the side of the first electrode 1 are transferred in the direction of the second electrode 2. On the other hand, the counter ions that were at the side of the second electrode 2 are transferred in the direction of the first electrode 1. FIG. 2B is a diagram showing the toner particles and the ions being transferred by the direction of the electric field at the time right after the electric field is reversed.

Figure 3:
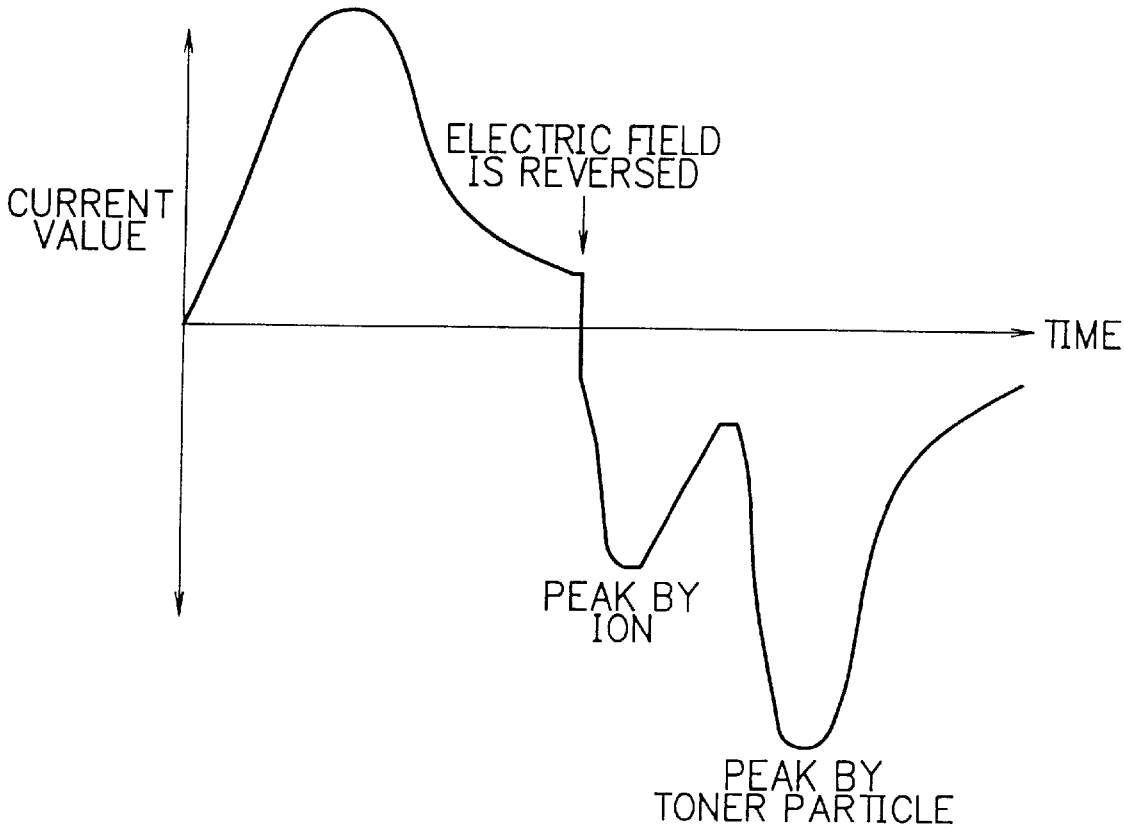
FIG. 3 is a graph showing a characteristic of a current value between electrodes.

FIG. 3 is a graph showing a change of a characteristic of a current value between electrodes. The change of the current value is detected at the ampere meter A. That is, as shown in the beginning part of FIG. 3, at the time when the electric field for the developer D is generated by the first power supply 3, the toner particles, the counter ions and the excess ions are distributed uniformly between the electrodes. Therefore, there is no distinction between the toner particles and the ions in the detected current value, and the current effected by both toner particles and the ions is detected. In this operation, the toner particles are transferred to the side of the first electrode 1, and as shown in FIG. 2A, the distribution of the toner particles between the electrodes becomes non-uniform.

After the electric field is reversed, the toner particles and both ions are transferred to the opposite electrode respectively, but the transferring speed is different between the toner particles and the ions. Therefore, the detected current is shown to have two peaks, one is effected by the ions and the other is effected by the toner particles. Generally, the transferring speed of ions is faster than that of toner particles, therefore, first, the current value effected by the ions is detected and after this the current value effected by the toner particles is detected, as shown in the second half part of FIG. 3.

Figure 4A:
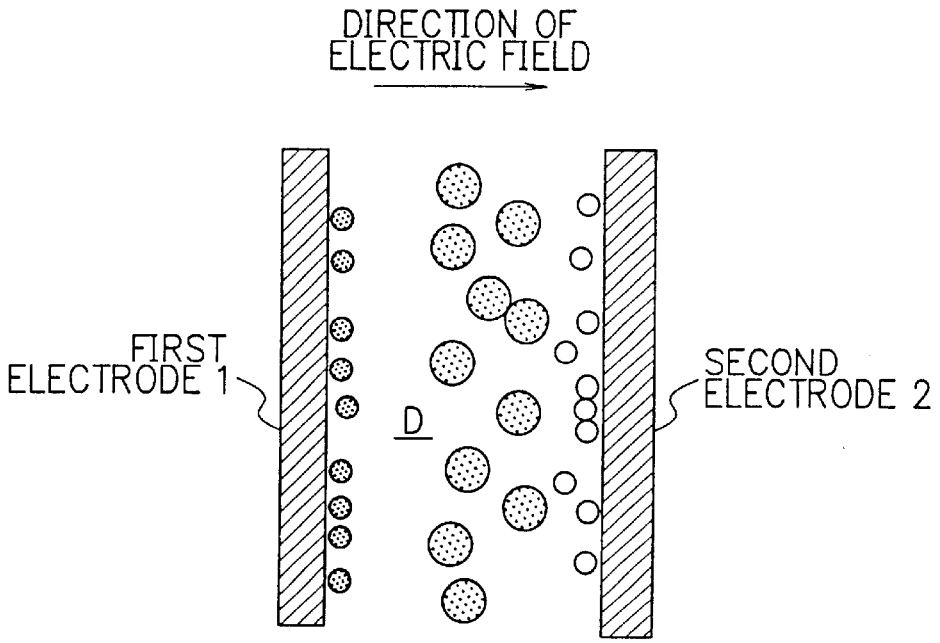
FIG. 4A is a diagram showing toner particles and ions being transferred by the direction of electric field after the electric field is reversed.
Figure 4B:
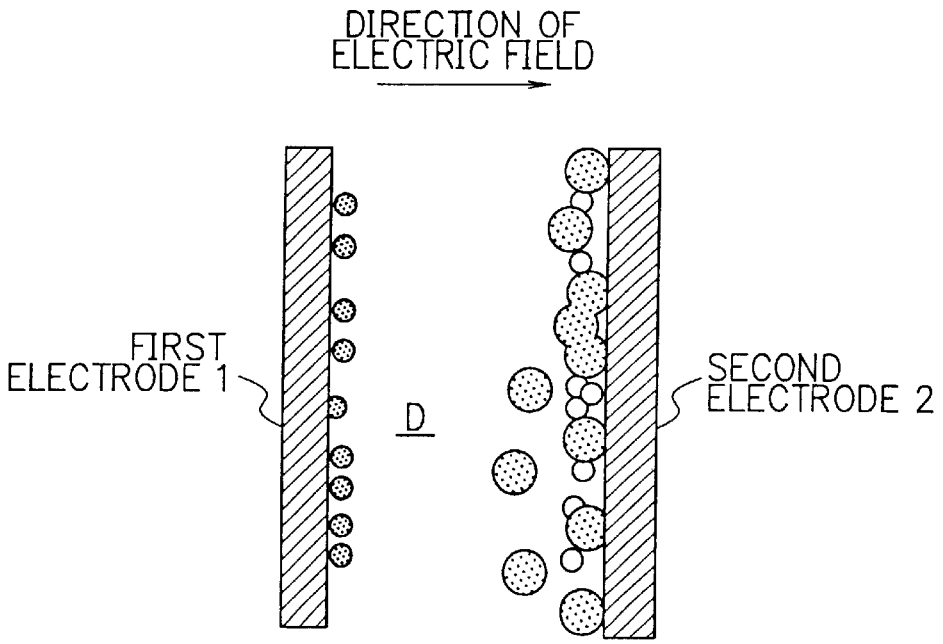
FIG. 4B is a diagram showing toner particles and ions being transferred by the direction of electric field after the electric field is reversed, at the time after the state shown in FIG. 4A.

FIGS. 4A and 4B are diagrams showing that the toner particles and ions are transferred by the direction of electric field after the electric field is reversed.

The current value detected by the ampere meter A is supplied to the toner concentration calculating means 5. The current value effected by the toner particles is compared with a table made beforehand in which the relation between the toner concentration and the current value effected by the toner particles is described. With this, the toner concentration in the developer D without any influence of ions can be calculated with high accuracy.

Figure 5:
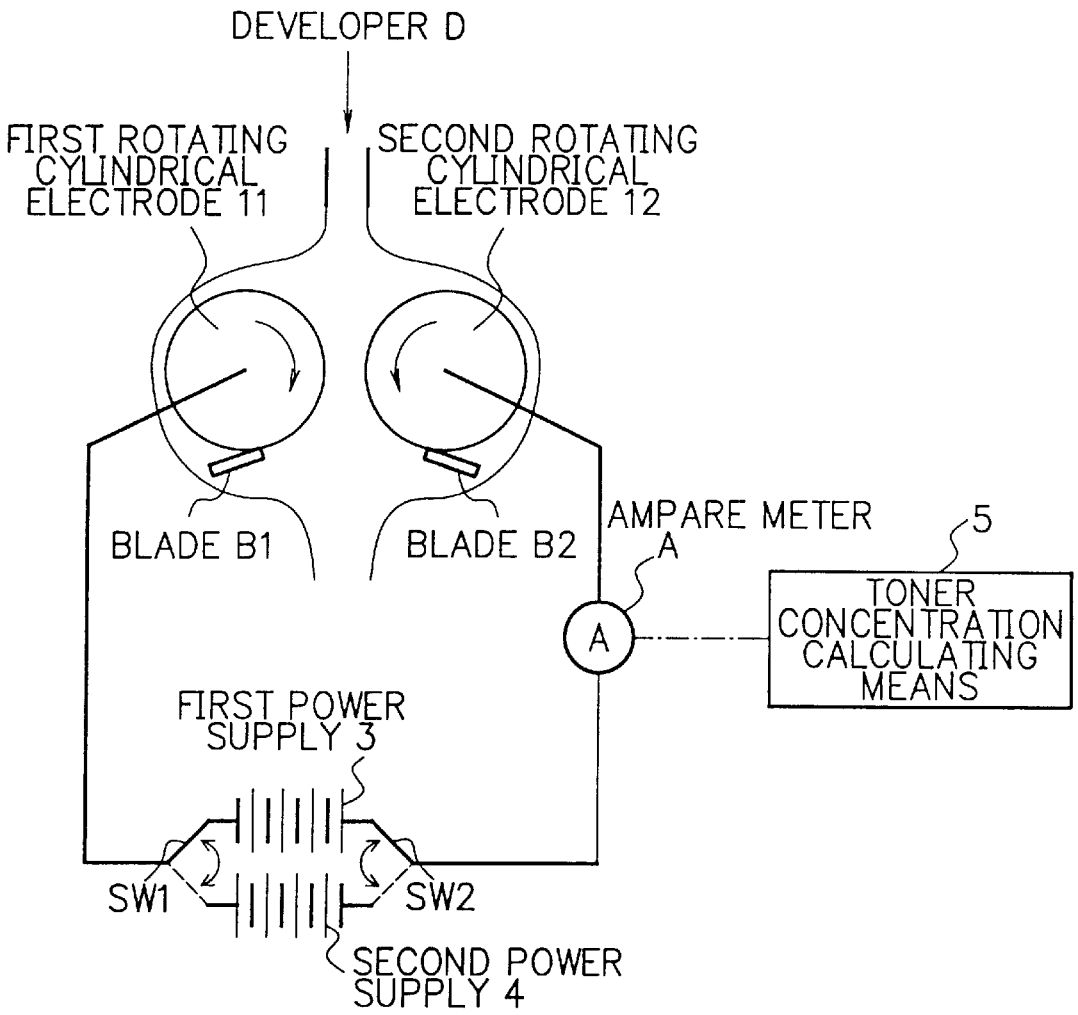
FIG. 5 is a diagram showing the structure of a second embodiment of a toner concentration detecting apparatus of the present invention.

FIG. 5 is a diagram showing the structure of a second embodiment of a toner concentration detecting apparatus of the present invention. The electrodes of the first embodiment are shaped like plates, however in the second embodiment, as shown in FIG. 5, the electrodes have rotating cylindrical shape. Therefore, the toner concentration detecting apparatus of the second embodiment provides a first rotating cylindrical electrode 11 and a second rotating cylindrical electrode 12. And further this apparatus provides blades B1 and B2 that make the surfaces of both rotating cylindrical electrodes 11 and 12 clean. The other parts of the second embodiment are the same as the first embodiment.

In the second embodiment, both electrodes have rotating cylindrical shape and the blades B1 and B2 are provided as cleaner, therefore this apparatus can continuously detect the toner concentration, while eliminating toner particles adhering to the surfaces of the electrodes. The toner particles are adhered to the surface of the electrodes by, for example, the Van der Waals force or the mirror-image force, in addition to the electrostatic force. Consequently, even when a reverse electric field is applied to the electrodes, the toner particles adhering to the electrodes can not be eliminated completely. Therefore, by cleaning the electrodes with blades, more accurate detection can be obtained.

In the method of calculating the toner concentration from the change of the current value as shown in FIG. 3, during the time the current value due to the toner particles, is changing there are four ways of calculating. In the first method, the toner concentration is calculated by using the peak current due to the toner particles, second, concentration is calculated by the slope of the graph of the peak current value due to toner particles, third, concentration is calculated by the time from applying the reverse electric field to reaching the current peak value due to toner particles, and last concentration is calculated by the relation between the current value due to ions and that due to the toner particles, that is, by the difference between the respective peak values or the time difference between reaching the respective peak values.

The toner concentration calculating apparatuses shown in FIGS. 1 and 5 are realized by a computer system constituted of a central processing unit (CPU) and a memory and so forth. In this case, the memory becomes a program storage medium. As the storage medium, a semiconductor memory, an optical disk, a magnetic optical disk and a magnetic medium and so forth can be utilized.

Moreover, a data storage medium that stores the table describing the relation between the toner concentration and the current value by the toner particles, which the toner concentration calculating means uses, becomes a data storage medium of the present invention.

As mentioned above, the present invention uses a pair of electrodes, and switches only the polarity of the power supply to be applied to the electrodes and detects current value. With this, the influence of ions can be reduced largely and highly accurate information for the toner concentration can be obtained.

Moreover, conventional electrodes and power supplies can be utilized and additional designing is scarcely needed. Therefore the construction can be made simple and small, and the apparatus can be installed easily and realized at low cost. Because the distance between electrodes is about 0.5 to 3.0 mm, it does not take long time for switching the power supply and for detecting the current value. In a color developer, an adjustment for each color is not needed and the installation is easy.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A toner concentration detecting apparatus, comprising:

a first electrode and a second electrode which are disposed face to face with a developer between said electrodes;

two power supplies, either one of which applies a voltage to said firs t electrode and said second electrode at one time;

a switching means which switches polarity of said power supplies by switching from one power supply to the other power supply, after one power supply applied a voltage to said first electrode and said second electrode for a designated time;

a detecting means which detects current flowing between said first electrode and said second electrode, at the time after applying voltage to said first electrode and said second electrode and after switching the polarity of said power supplies; and a calculating mean s which calculates a toner concentration of said developer, based on detected current values due to both ion and toner particles.

2. A toner concentration detecting apparatus in accordance with claim 1, wherein:

said calculating means calculates said toner concentration by using a table which shows the relation between the toner concentration and the current values due to toner particles.

3. A toner concentration detecting apparatus in accordance with claim 1, wherein:

said calculating means calculates said toner concentration by using a peak value due to toner particles during a time when said detected current values are changing.

4. A toner concentration detecting apparatus in accordance with claim 1, wherein:

said calculating means calculates said toner concentration by a time from the time when said polarity of said power supplies is switched to the time when said detected current values reach a peak value due to toner particles during a time when said detected current values are changing.

5. A toner concentration detecting apparatus in accordance with claim 1, wherein:

said first electrode and said second electrode are rotating cylindrical electrodes, and additionally cleaners, which clean surfaces of said rotating cylindrical electrodes, are provided.

6. A toner concentration detecting apparatus, comprising:

a first electrode and a second electrode which are disposed face to face with a developer between said electrodes;

two power supplies, either one of which applies a voltage to said first electrode and said second electrode at one time;

a switching means which switches polarity of said power supplies by switching from one power supply to the other power supply, after one power supply applied a voltage to said first electrode and said second electrode for a designated time;

a detecting means which detects current flowing between said first electrode and said second electrode, at the time after applying voltage to said first electrode and said second electrode and after switching the polarity of said power supplies; and a calculating means which calculates a toner concentration of said developer, based on detected current values, wherein:

said calculating means calculates said toner concentration by a rate of change of said detected current values from the time when said electric field is reversed to the time when said detected current values reach a peak value due to toner particles during a time when said detected current values are changing.

7. A toner concentration detecting apparatus, comprising:

a first electrode and a second electrode which are disposed face to face with a developer between said electrodes;

two power supplies, either one of which applies a voltage to said first electrode and said second electrode at one time;

a switching means which switches polarity of said power supplies by switching from one power supply to the other power supply, after one power supply applied a voltage to said first electrode and said second electrode for a designated time;

a detecting means which detects current flowing between said first electrode and said second electrode, at the time after applying voltage to said first electrode and said second electrode and after switching the polarity of said power supplies; and a calculating means which calculates a toner concentration of said developer, based on detected current values; wherein:

said calculating means calculates said toner concentration by the relation between a current value due to ions and a current value due to toner particles during a time when said detected current values are changing.

8. A program storage medium, in a toner concentration detecting apparatus, for storing a program comprising the steps of:

applying a voltage to a first electrode and a second electrode which are disposed face to face with a developer between said electrodes from one of two power supplies for a designated time;

then switching polarity of said power supplies by switching from said one of said two power supplies to the other of said two power supplies;

detecting current flowing between said first electrode and said second electrode, after said step of switching the polarity of said power supplies; and calculating a toner concentration of said developer, based on detected current values due to both ions and toner particles.

9. A program storage medium in accordance with claim 8, wherein:

said calculating step calculates said toner concentration by using a table which shows the relation between the toner concentration and the current values due to toner particles.

10. A program storage medium, in a toner concentration detecting apparatus, for storing a program comprising the steps of:

applying a voltage to a first electrode and a second electrode which are disposed face to face with a developer between said electrodes from one of two power supplies for a designated time;

then switching polarity of said power supplies by switching from said one of said two power supplies to the other of said two power supplies;

detecting current flowing between said first electrode and said second electrode, after said step of switching the polarity of said power supplies; and calculating a toner concentration of said developer, based on detected current values; wherein:

said calculating step calculates said toner concentration by using a peak value due to toner particles during a time when said detected current values are changing.

11. A program storage medium, in a toner concentration detecting apparatus, for storing a program comprising the steps of:

applying a voltage to a first electrode and a second electrode which are disposed face to face with a developer between said electrodes from one of two power supplies for a designated time;

then switching polarity of said power supplies by switching from said one of said two power supplies to the other of said two power supplies;

detecting current flowing between said first electrode and said second electrode, after said step of switching the polarity of said power supplies; and calculating a toner concentration of said developer, based on detected current values; wherein:

said calculating step calculates said toner concentration by a rate of change of said detected current values from the time when said electric field is reversed to the time when said detected current values reach a peak value due to toner particles during a time when said detected current values are changing.

12. A program storage medium, in a toner concentration detecting apparatus, for storing a program comprising the steps of:

applying a voltage to a first electrode and a second electrode which are disposed face to face with a developer between said electrodes from one of two power supplies for a designated time;

then switching polarity of said power supplies by switching from said one of said two power supplies to the other of said two power supplies;

detecting current flowing between said first electrode and said second electrode, after said step of switching the polarity of said power supplies; and calculating a toner concentration of said developer, based on detected current values; wherein:

said calculating step calculates said toner concentration by a time from the time when said polarity of said power supplies is switched to the time when said detected current values reach a peak value due to toner particles during a time when said detected current values are changing.

13. A program storage medium, in a toner concentration detecting apparatus, for storing a program comprising the steps of:

applying a voltage to a first electrode and a second electrode which are disposed face to face with a developer between said electrodes from one of two power supplies for a designated time;

then switching polarity of said power supplies by switching from said one of said two power supplies to the other of said two power supplies;

detecting current flowing between said first electrode and said second electrode, after said step of switching the polarity of said power supplies; and calculating a toner concentration of said developer, based on detected current values; wherein:

said calculating step calculates said toner concentration by the relation between a current value due to ions and a current value due to toner particles during a time when said detected current values are changing.

14. In combination, a program storage medium, in a toner concentration detecting apparatus, for storing a program comprising the steps of:

applying a voltage to a first electrode and a second electrode which are disposed face to face with a developer between said electrodes from one of two power supplies for a designated time;

then switching polarity of said power supplies by switching from said one of said two power supplies to the other of said two power supplies;

detecting current flowing between said first electrode and said second electrode, after said step of switching the polarity of said power supplies; and calculating a toner concentration of said developer, based on detected current values due to both ions and toner particles;

a data storage medium, in said toner concentration detecting apparatus, wherein:

data constituting a table, which shows the relation between the toner concentration and the current values due to toner particles flowing between a first electrode and a second electrode disposed face to face with a developer between the electrodes, are stored for use in said program.

* * * * *